US005157309A

United States Patent [19]

Parker et al.

[11] Patent Number: 5,157,309

[45] Date of Patent: Oct. 20, 1992

[54] COLD-CATHODE FIELD EMISSION DEVICE EMPLOYING A CURRENT SOURCE MEANS

[75] Inventors: Norman W. Parker, Wheaton; Robert C. Kane, Woodstock, both of Ill.

[73] Assignee: Motorola Inc., Schaumburg, Ill.

[21] Appl. No.: 582,441

[22] Filed: Sep. 13, 1990

[51] Int. Cl.[5] ..... H01J 29/70; H01J 1/02

[52] U.S. Cl. ..... 315/169.1; 313/309; 313/336

[58] Field of Search ..... 315/169.1, 169.4, 334, 315/338; 313/308, 309, 336

[56] References Cited

U.S. PATENT DOCUMENTS

| | | | |
|---|---|---|---|
| 3,704,386 | 11/1972 | Cola | 315/169.1 |
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,894,332 | 7/1975 | Nathanson et al. . | |
| 3,921,022 | 11/1975 | Levine . | |
| 3,970,887 | 7/1976 | Smith et al. . | |
| 3,998,678 | 12/1976 | Fukase et al. . | |
| 4,008,412 | 2/1977 | Yuito et al. . | |
| 4,178,531 | 12/1979 | Alig . | |
| 4,307,507 | 12/1981 | Gray et al. . | |
| 4,513,308 | 4/1985 | Greene et al. . | |
| 4,578,614 | 3/1986 | Gray et al. . | |
| 4,685,996 | 8/1987 | Busta et al. . | |
| 4,721,885 | 1/1988 | Brodie | 313/576 |
| 4,728,851 | 3/1988 | Lambe | 313/309 |
| 4,827,177 | 5/1989 | Lee et al. | 313/306 |
| 4,874,981 | 10/1989 | Spindt | 313/309 |
| 4,884,010 | 11/1989 | Biberian | 313/309 |
| 4,901,028 | 2/1990 | Gray et al. . | |
| 4,904,895 | 2/1990 | Tsukamoto et al. | 313/336 |
| 4,908,539 | 3/1990 | Meyer | 315/169.4 |
| 4,990,766 | 2/1991 | Simms et al. | 250/213 VT |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM.

Advanced Technology: flat cold-cathode CRTs, by Ivor Brodie, Information Display Jan. 1989.

Field-Emitter Arrays Applied to Vacuum Flourescent Display, by Spindt et al. Jan., 1989 issue of IEEE Transactions on Electronic Devices.

Field Emission Cathode Array Development For High--Current Density Applications by Spindt et al., dated Aug., 1982 vol. 16 of Applications of Surface Science.

*Primary Examiner*—Eugene R. LaRoche
*Assistant Examiner*—Son Dinh
*Attorney, Agent, or Firm*—Eugene A. Parsons

[57] ABSTRACT

A cold-cathode field emission device controls electron emission by using a current source coupled to the emitter. The open circuit voltage of the current source is less than the voltage at which the FED would emit electrons. Application of an accelerating potential on the gate enables electron emission. Electron emission from the FED is governed by the current source.

13 Claims, 2 Drawing Sheets

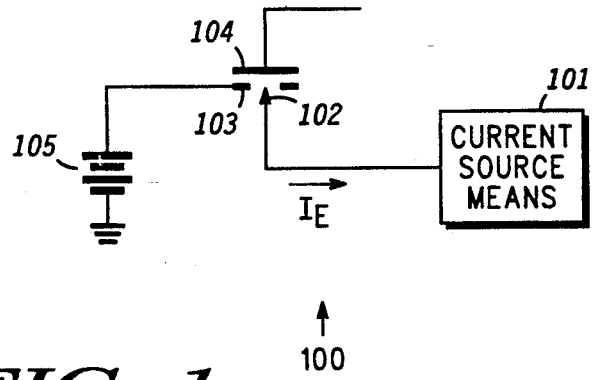
FIG. 1
FIG. 2
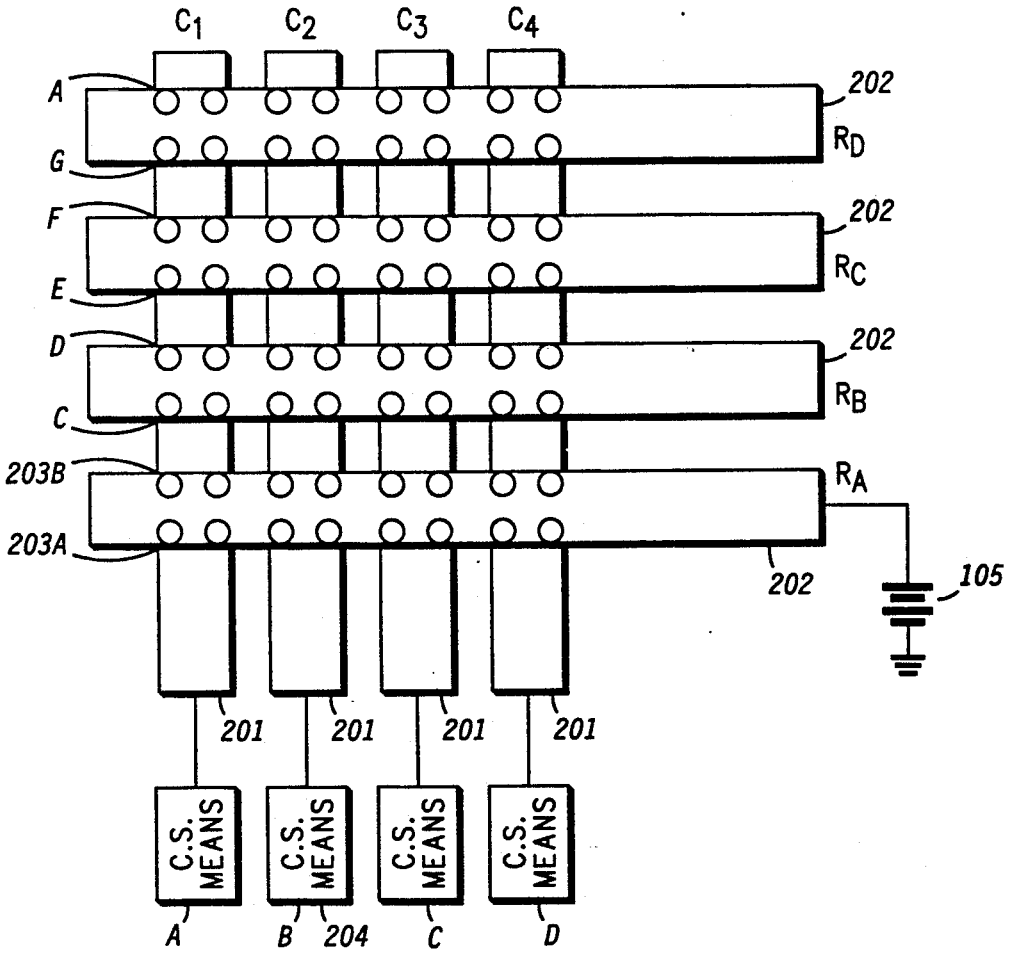

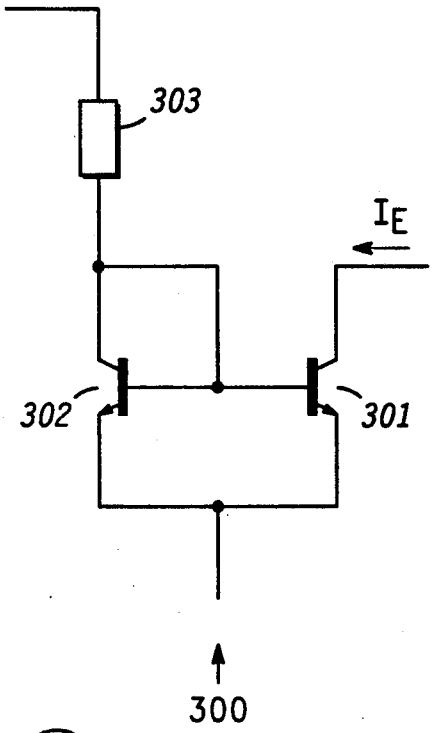
FIG. 3
FIG. 4
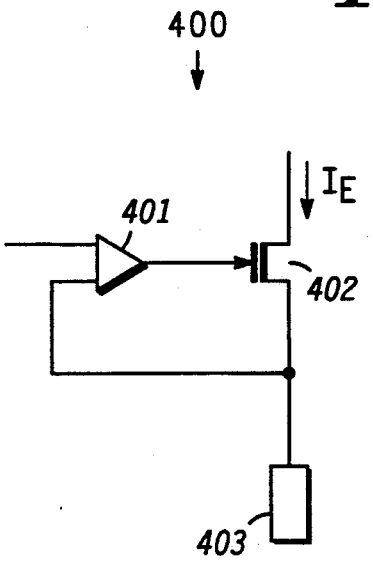

COLD-CATHODE FIELD EMISSION DEVICE EMPLOYING A CURRENT SOURCE MEANS

TECHNICAL FIELD

This invention relates generally to cold-cathode field emission devices and more specifically to methods and devices used to control electron emission from cold-cathode field emission devices.

BACKGROUND OF THE INVENTION

Cold-cathode field emission devices (FEDs) are known in the art. FEDs can be constructed by a variety of processes, virtually all of which yield structures that emit electrons from an emitter electrode.

A common problem with FEDs is that emitter electron emission is not accurately controllable, due at least in part to FED fabrication inconsistencies. Electronic devices that are comprised of arrays of large numbers of FEDs can yield a minority of heavily conducting field emission devices and a majority of non-conducting field emission devices. As such, various methods have been employed as attempts to realize FEDs with accurately controlled electron emission.

Known methods of controlling FED emission require that a controlling voltage be employed to modulate or limit the electron emission. Since FED emission characteristics are related to process variables, it is not practical to establish a voltage/emission relationship which will be applicable for successive FED fabrications or to individual FEDs within a group from a single fabrication.

Accordingly, there exists a need for accurately controlling electron emission from FEDs.

SUMMARY OF INVENTION

The need for controlling electron emission from FEDs is substantially met by employing a current source, coupled to the emitter electrode of an FED to control emitter electron emission. In one embodiment, the open circuit voltage of the current source is selected to induce emitter electron emission regardless of the gate voltage. In the preferred embodiment, the open circuit voltage of the current source is chosen to be insufficient to induce appreciable electon emission from the emitter electrode in the absence of an appropriate extraction potential on the gate. An appropriate extraction potential on the gate would be determined by the open circuit voltage of the emitter current source so as to produce a sufficient potential difference between the gate and the emitter to establish the electric field necessary to effect emitter electron emission.

In alternate embodiments of the invention that would include multiple FEDs forming an array of FEDs, such as a two-dimensional array of FEDs, a current source might be coupled to either the emitter of each device, or to the emitters of a group FEDs. Further, a plurality of current sources may be selectively independently coupled to individual emitters or groups of emitters in an array of FEDs. In such arrangements, the current sources can control electron emission from the FEDs.

(For the purposes of this disclosure, a current source can be considered to include any determinate source of electrons. Some exemplary current sources are briefly described herein.)

BRIEF DESCRIPTION OF THE DRAWINGS

FIG. 1 comprises a schematic diagram of an FED with an emitter current source and gate voltage source.

FIG. 2 comprises a top view of an array of clustered FEDs. Each FED cluster has four individual FEDs.

FIGS. 3 and 4 are schematic depictions of current sources.

DETAILED DESCRIPTION OF THE PREFERRED EMBODIMENT

Referring now to FIG. 1 an FED circuit (100) for controlling FED electron emission is depicted that includes an FED having an emitter electrode (102), a gate electrode (103) and an anode (104). The emitter electrode (102) is coupled to a current source (101) that controls electron emission from the emitter electrode (102). Depending upon the open circuit voltage of the current source (101) an appropriate extraction potential (105) may be applied to the gate electrode to induce electron emission. (As stated above, the electrons supplied by the current source will be emitted from the emitter when the gate emitter potential is sufficient to induce emitter electon emission.)

In the embodiment shown in FIG. 1 an anode (104) collects at least some of the electrons emitted from the emitter (102). Other FED circuits might not utilize electron-collecting anodes.

FIG. 2 depicts a top view of an array (200) of FEDs (203), each FED being similar to the FED shown in FIG. 1. The plurality of FEDs (203) shown in FIG. 2 are symmetrically arranged along columns ($C_1$–$C_4$) and rows ($R_A$–$R_B$) with respect to each other. The emitter electrodes (102) of FEDs along a column ($C_1$ for example) are operably coupled to a corresponding column ($C_1$) while the gate electrodes (103) of the FEDs along a row ($R_A$ for example) are operably connected to a corresponding row ($R_A$). (In the embodiment shown in FIG. 2, at each cross-over of a column and row, four FEDs are shown. Alternate embodiments would include a single FED at each cross over as well as any number of FEDs at each cross over.)

Rotation of the structure shown in FIG. 2 by 90 degrees, alters the designation of rows and columns wherein references to columns and rows are interchanged.

The columns of interconnected emitter electrodes (102) of the FEDs (203) are formed during fabrication of the FEDs (203) by selectively connecting the emitter electrodes (102) of the corresponding FEDs (203) to column conductor stripes (201). The column conductor stripes (201) may be formed by any of the commonly known methodologies such as, for example: evaporation, sputtering, ion implantation, or diffusion doping, or any other appropriate technique. Rows of interconnected FEDs (203) are formed by selectively connecting the gate electrodes (103) of the corresponding FEDs (203) to row conductor stripes (202). The row conductor stripes (202) may be formed using any of the appropriate techniques as previously described for column conductor stripes (201).

The electronic device (200), depicted in FIG. 2, forms a matrix of FEDs addressed by row conductor stripes (202) and column conductor stripes (201), both of which may be selectively and independently energized to induce electron emission from one or more selected FEDs (203). Although the device shown in FIG. 2 depicts a plurality of FEDs (203) that can be selectively energized by any combination of a row conductor stripe (202) and column conductor stripe (201), alternative embodiments could provide for independently selecting a single FED (203) in an array of FEDs (203).

Electron emission in the FEDs shown in FIG. 2 is effected by coupling each column conductor stripe (201) to a current source (204). (Each column conductor stripe is connected to the emitter electrodes of its associated FEDs (203).)

The current source (204) provides a source of electrons that can be emitted by the emitter electrodes (102) of the FEDs (203), if an appropriate extraction potential is applied to at least one of the row conductor stripes (202). In the absence of an appropriate extraction potential (105) on any row conductor stripe (202), the output voltage of the current source (204) will increase, eventually reaching a pre-determined limit value. This open circuit voltage of the current source (204) should not be large enough to induce electron emission from the emitter (102) without the applied extraction potential (105). When an extraction potential is applied to at least one row conductor stripe (202), the output voltage of the current source (204) will assume a level necessary to induce electron emission, at the emitter electrodes of the FEDs (203), corresponding to the current level delivered by the current source (204).

Alternative embodiments might provide for electron emission to be induced independent of gate extraction potential; wherein the voltage level of the current source is not restricted to the pre-determined level as described above. Such alternative embodiments may provide that the gate electrode be operated at zero volts, or at a negative potential (less than zero), in which instance the operating voltage of the current source will be shifted correspondingly more negative so as to develop the prescribed gate to emitter potential differential required to establish the electric field necessary to effect electron emission.

As depicted in FIG. 2, each column conductor stripe (201) of a plurality of column conductor stripes (201) is connected to a single current source (204). Individual FEDs or, as depicted in FIG. 2 a plurality of FEDs (203) comprising a group of FEDs (203) or corresponding to a row conductor stripe (202) and a column conductor stripe (201) may be selected to emit an electron current prescribed by a current source (204). A plurality of columnarly independent FEDs (203) or groups of FEDs (203) can be simultaneously selected to emit an electron current prescribed by a plurality of current sources (204*a*–204*d*) that are each coupled to one of the plurality of columns by applying an appropriate extraction potential to a selected row conductor stripe (202*a*–202*d*). In this manner, a selected row of FEDs will emit an electron current with the emission level of each FED or group of FEDs (203) being modulated by the current source (204) connected to the column conductor stripe (201) associated with the FEDs (203) of the selected row and columns.

(Although a single current source is depicted as being coupled to each of the column conductor stripes, alternated embodiments might include multiple current sources coupled to a single column conductor stripe.)

Multi-row addressing of FEDs may be implemented by sequentially applying a single voltage source to each of the plurality of row conductor stripes or by selectively energizing each of a plurality of voltage sources coupled to each of the plurality fo row conductor stripes. If, while sequentially addressing each of the plurality of rows, the electron current to each of the plurality of columns is modulated, the resulting electron emission will be suitable for energizing an anode configured as a luminescent viewing screen. The resultant device is a cathodoluminescent display.

FIGS. 3 and 4 schematically depict possible embodiments of current sources that might be appropriate for implementing the current sources used in FIGS. 1 and 2. The current sources depicted are merely examples of some commonly known in the art and should not be considered as inclusive. Reference symbols in FIGS. 3, and 4 show current direction, rather than electron flow.

Referring to FIG. 3 a first embodiment of a current source (300) is shown that is comprised of a reference transistor (302), an output transistor (301), and a reference resistive circuit element (303), all of which are interconnected to provide a prescribed output transistor (301) collector current, $I_E$. The magnitude of the open circuit output voltage is established by the power supply for the current source (300).

FIG. 4 depicts a current source (400) comprised of an operational amplifier (401), an output transistor (402), and a resistive circuit element (403), all of which are inter-coupled to provide a prescribed output transistor (402) drain current, $1_E$.

We claim:

1. An electron emission controlled, cold-cathode field emission device (FED) circuit, comprising:

A. an FED having at least an emitter, a gate, and an anode;

B. a current source means, for supplying a determinate source of electrons, operably coupled to the emitter electrode of the cold-cathode field emission device having a maximum output voltage insufficient to induce electron emission from the emitter electrode without an appropriate extraction potential applied to said gate; and C. an extraction potential source coupled to the gate electrode, the extraction potential source being selected to cause emitter electron emission when the current source means is coupled to the emitter.

2. An electron emission controlled, cold-cathode field emission device (FED) circuit, comprising:

A. a plurality of FEDs, each including at least an emitter electrode, a gate electrode and an anode electrode;

B. at least one current source means for supplying a determinate source of electrons, operably coupled to at least some of the emitter electrodes of the plurality of FEDs having a maximum output voltage insufficient to induce electron emission from the emitter electrodes of the plurality of FED's without an appropriate extraction potential voltage applied to said gate; and C. a voltage source means coupled to at least some of the gate electrodes of the plurality of FED's, said voltage source means output voltage selected to cause emitter electron emission from at least some of said FED's when said at least one current source means is supplying electrons.

3. An electron emission controlled, cold-cathode field emission device (FED) circuit, comprising:

A. a plurality of FEDs, each including an emitter electrode, a gate electrode and an anode electrode;

B. a plurality of current source means for supplying a determinate source of electrons to the emitter electrodes of the plurality of FEDs, each current source of said plurality of sources being coupled to at least one emitter electrode of said plurality of FEDs.

4. The electron emission controlled, cold-cathode field emission device (FED) circuit of claim 3 further comprising a plurality of current source means for supplying electrons to the emitter electrodes of the plurality of FEDs, each current source means having an open circuit voltage insufficient to induce appreciable electron emission from the emitter electrodes of the plurality of FEDs in the absence of an extraction potential being applied to the gate electrode.

5. The electron emission controlled, cold-cathode field emission device (FED) circuit of claim 3 further comprising means for applying a voltage to the gate electrode of the plurality of FEDs.

6. An electron emission controlled, cold-cathode field emission device (FED) circuit, comprising:

A. a plurality of FEDs arranged in a substantially symmetric two-dimensional array, each FED including at least an emitter electrode, a gate electrode and an anode;

B. a plurality of first and second, substantially co-planar, conductor stripes, the first conductor stripes being substantially orthogonal to the second conductor stripes, a first set of first conductor stripes being selectively independently coupled to at least some of the emitter electrodes of the plurality of FEDs, a first set of second conductor stripes being selectively independently coupled to at least some of the gate electrodes of the plurality of FEDs;

C. a plurality of current source means for supplying a determinate source of electrons, selectively independently coupled to at least some of the first set of first conductor stripes, said current sources having maximum output voltages insufficient to induce appreciable electron emission from the emitter electrode of an FED in the absence of an extraction potential voltage applied to the gate electrode of the FED;

D. a plurality of voltage sources coupled to the first set of second conductor stripes, each voltage source applying an extraction potential to the first set of second conductor stripes sufficient to induce emitter electron emission when a current source is supplying electrons.

7. The electron emission controlled, cold-cathode field emission device of claim 6, wherein each voltage source of said plurality of voltage sources is selectively independently coupled to a single one of said second conductor stripes.

8. The electron emission controlled, cold-cathode field emission device (FED) circuit of claim 6 including a single voltage source selectively independently sequentially coupled to the each conductor stripe of the first set of second conductor strips, said voltage source being capable of applying an extraction potential voltage to the second conductor stripes.

9. The electronic device of claim 6, wherein the plurality of FEDs are disposed in a symmetric array of a plurality of rows and a plurality of columns.

10. The electronic device of claim 6, wherein the rows and columns are substantially orthogonal.

11. The electronic device of claim 6, wherein said plurality of current source means for supplying electrons includes a plurality of current sources each of which is coupled to one of said first conductor stripes.

12. The electronic device of claim 6, wherein each current source means of the plurality of current source means for supplying electrons, is coupled to a single one of said first set of first conductor stripes. whereby each of the plurality of column conductor stripes is operably coupled to a single current source means.

13. An electron emission controlled, cold-cathode field emission device (FED) circuit comprised of:

a plurality of FEDs each of which is comprised of at least an emitter electrode, a gate electrode, and an anode electrode;

a plurality of first conductive stripes selectively independently operably coupled to the emitter electrodes of at least some of the plurality of FEDs;

a plurality of current source means, for supplying a determinate source of electrons, said current sources having maximum output voltages insufficient to induce appreciable electron emission from the emitter electrodes of an FED in the absence of an extraction potential applied to the gate electrode of the FED, each of which plurality of current source means is selectively independently operatively coupled to one of the plurality of first conductive stripes;

a plurality of second conductive stripes selectively independently operably coupled to the gate electrodes of at least some of the plurality of FEDs;

a voltage source, for applying an extraction potential sufficient to induce emitted electron emission from the emitters of the FEDs, selectively independently coupled to at least one of the plurality of second conductive stripes.

* * * * *